US005249618A

United States Patent [19]

Burkarth et al.

[11] Patent Number: 5,249,618

[45] Date of Patent: Oct. 5, 1993

[54] METHOD OF MAKING A COMPLEX CERAMIC CORE FOR USE IN METAL CASTING PROCESS

[75] Inventors: Nadine Burkarth, Courbevoie; Christian Marty, Boulogne Billancourt, both of France

[73] Assignee: Societe Nationale D'Etude et de Construction de Moteurs D'Aviation "S.N.E.C.M.A.", Paris, France

[21] Appl. No.: 827,607

[22] Filed: Jan. 29, 1992

[30] Foreign Application Priority Data

Jan. 30, 1991 [FR] France ..... 91 01022

[51] Int. Cl.[5] ..... B22C 9/10

[52] U.S. Cl. ..... 164/24; 164/28; 164/369

[58] Field of Search ..... 164/23, 24, 27, 28, 164/122.1, 122.2, 516, 519, 365, 369

[56] References Cited

U.S. PATENT DOCUMENTS 2,906,495 9/1959 Schum et al. .
2,977,089 3/1961 McCarthy et al. .

FOREIGN PATENT DOCUMENTS 2090181 7/1982 United Kingdom .
2107405 4/1983 United Kingdom .
2159585 12/1985 United Kingdom .

OTHER PUBLICATIONS

Patent Abstracts of Japan, vol. 7, No. 133(M221) [1278], Jun. 10, 1983, & JP-A-58-48702, Mar. 22, 1983, S. Kobayashi, et al., "Air Cooled Vane in Gas Turbine".

*Primary Examiner*—Kuang Y. Lin
*Attorney, Agent, or Firm*—Oblon, Spivak, McClelland, Maier & Neustadt

[57] ABSTRACT

A method of making a complex ceramic core for use in a metal casting process of the lost wax type, the core having at least one recess which extends into the interior of the core and being intended for use in the manufacture of a hollow component having internal cavities and partitions, including successive and superimposed injections of at least two compounds, one of which is degradable without harming the other(s), in at least one mold to produce a solid body wherein the other(s) of the compounds forms said core and the degradable compound fills the recesses of the core. The first injection creates a blank from one or other of the compounds, and each successive injection forms a layer which covers, at least partly, the outer surface of the blank obtained after the preceding injection until the solid body is completed. The body is then treated to remove the degradable compound and thereby leave the desired complex core.

1 Claim, 1 Drawing Sheet

METHOD OF MAKING A COMPLEX CERAMIC CORE FOR USE IN METAL CASTING PROCESS

BACKGROUND OF THE INVENTION

1. Field of the invention

The invention relates to a method of making a complex ceramic core for use in a metal casting process of the type known as the lost wax process, the core having a solid part of ceramic material and at least one recess which extends into the interior of the core, and the core being intended for use in the manufacture of a hollow component comprising internal cavities and partitions, especially a blade for a turboshaft engine.

2. Description of the prior art

In the lost wax casting process use is made of a core of ceramic material which is held in the mold when the metal is cast, the outer surface of the core defining the inner surface of an internal cavity of the finished product obtained in this way.

In some cases, the core used must have recessed portions so as to form partitions in the finished product. Such is the case with cores used in the manufacture of hollow blades for turboshaft engines, these hollow blades having, in their internal cavity, partitions for defining channels for the flow of cooling fluids, and possibly fins for the cooling of the outer walls of the blades.

To make these cores it has already been proposed to make a solid body formed by the core in which the recessed portions are filled by a degradable material, and then to eliminate the degradable composition filling the recessed portions. GB Patent 2 090 181 teaches a method of manufacturing a hollow turboshaft engine blade having an inner partition, in which a partition shape is made from a degradable material by a first injection of degradable material in an appropriate mold, the partition shape of degradable material is molded around by injecting a ceramic based composition in a second mold, and the degradable material is subsequently disposed of by a removal process dependent upon the degradable material used.

However, the method described in this British patent has a few drawbacks and limitations on its use. Firstly, the partition which is made from the degradable material is a thin wall, and this fineness may cause problems when removing the partition from the first mold. Furthermore, the partition may become deformed or may break when injecting the ceramic composition in the second mold as a consequence of the pressures which are exerted on the two faces of the thin wall of degradable material and which do not necessarily balance during the second molding phase. This may result in internal malformation of the casting core, and hence a malformation of the blade made using this core. Finally, in the first injection, it is difficult to produce a complex body comprising a plurality of interconnected thin walls of degradable material, because of undercuts which make it impossible to remove this complex body of degradable material from the mold. This is the reason why turboshaft engine blades which have a complex inner network of partitions are not wholly made by the lost wax casting process. The partitions are made by brazing jackets inside the hollow blade, which involves labor costs, possible changes to the metal and difficulties with ensuring the sealing of the walls.

SUMMARY OF THE INVENTION

It is an object of the present invention to provide a method of making cores on the type mentioned above which obviates these drawbacks.

To this end, according to the invention there is provided a method of making a complex ceramic core for use in a metal casting process, the core having at least one recess which extends into the interior of said core and the core being intended for use in the manufacture of a hollow component having internal cavities and partitions, such as a blade for a turboshaft engine, by the known casting process termed the lost wax process, said method comprising the steps of successively injecting at least two compounds, one of which compounds is degradable without harming the other of said compounds, in a superimposed manner in at least one suitable mold to make a solid body wherein said other of said at least two compounds forms said core and said degradable one of said compounds fills said at least one recess of said core, the first of said injection steps creating a blank formed of one of said at least two compounds, and each successive injection step forming a layer of the injected compound covering, at least partly, the outer surface of the blank obtained in the preceding injection step, and treating said solid body to remove said degradable compound therefrom and thereby obtain said complex core.

With this method, the blank increases in size as successive layers are added on, and the shape of each successive blank obtained may be designed so that no problem due to undercuts should arise on removing the blank from the mold. The shape of the recessed portions filled with degradable material may be as complex as desired, and the walls formed by this part of the body may be extremely thin since there is no danger of deformation of these thin portions when removing the blank or body from the mold or when making the successive injections.

Preferably, one and the same mold is used for all the superimposed successive injections, and a suitable insert is placed in the mold to define the desired molding cavity for each injection step.

Other features and advantages of the invention will become apparent from the following description, given by way of example, of a preferred embodiment with reference to the attached drawings.

DESCRIPTION OF THE PREFERRED EMBODIMENT

Figure 1:
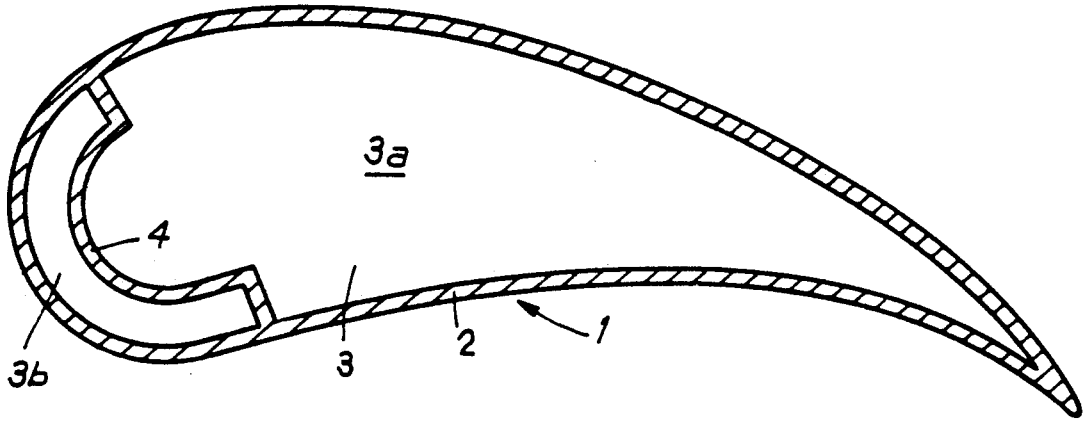
FIG. 1 is a cross section through one example of a hollow blade for a turboshaft engine.

FIG. 1 shows diagrammatically a hollow blade 1 for a turboshaft engine, the blade having an outer wall 2 and an inner cavity 3. The inner cavity 3 is provided with a partition 4 which divides it into channels 3*a*, 3*b* in which cooling fluids flow, or which acts as a cooling fin. The partition 4 and the outer wall 2 may, in addition, have openings for the passage of cooling fluids from one channel to another, or for the evacuation of cooling fluids.

This blade 1 is made as a casting by the known so-called lost wax process, which involves the casting of a metal into a mold containing a core 5 made of a ceramic material. At the end of the casting, the core 5 is encased within the blade 1, and is subsequently removed by any suitable method.

Figure 2:
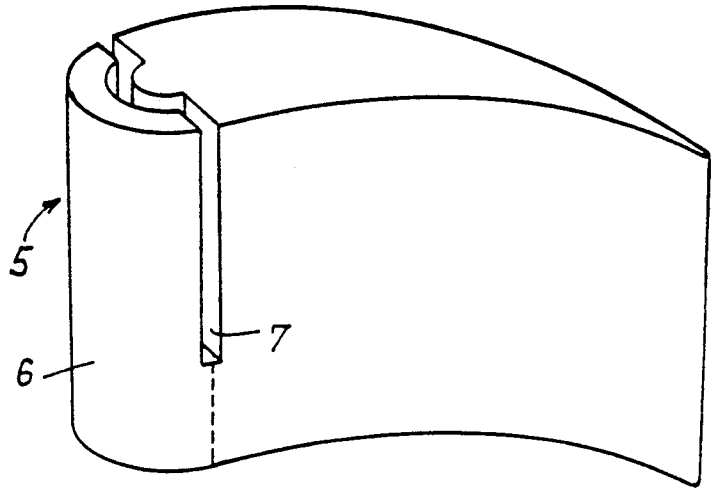
FIG. 2 is a perspective view of a ceramic core suitable for use in making the blade shown in FIG. 1 by a lost wax casting process.

The partition 4 situated inside the blade 1 may have a complex configuration; and therefore the core 5 also has a complex configuration. It has a solid part 6 of ceramic material which is intended to form the inner cavities of the blade 1, and recessed portions 7 which extend into the solid part 6. These recessed portions 7 are intended to give rise to the walls 4 of the blade 1 when the metal is cast. FIG. 2 shows the core 5 which enables the blade shown in FIG. 1 to be cast.

Figure 3:
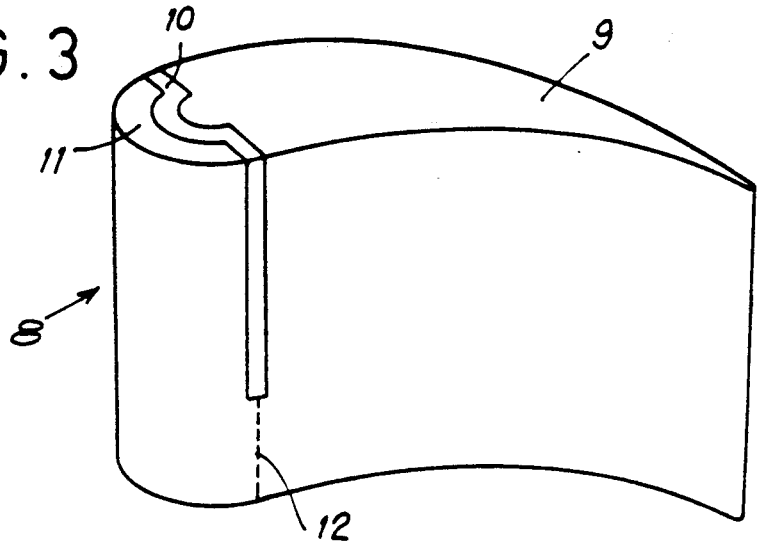
FIG. 3 is a perspective view of a solid body obtained in forming the core of FIG. 2 by a method in accordance with the invention.

In making the core 5 a solid body 8 as shown in FIG. 3 is first made wherein the body consists of said core 5 in which the recessed portions 7 are filled with a degradable material.

In accordance with the invention the solid body 8 is made by superimposed injections, preferably in the same mold, of at least two different compositions, one of which is degradable, and the other of which consists of a first binder and a ceramic material which is traditionally used for casting cores. The degradable composition consists of a second binder and a degradable material, such as graphite, for example, which decomposes under the action of heat in a suitable atmosphere.

As may be seen in FIG. 3, the solid body 8 is in three parts: a part 9 corresponding to the cavity 3*a* of the blade 1, a part 10 corresponding to the partition 4, and a part 11 corresponding to the cavity 3*b*. The part 9 is made first by injecting the ceramic based composition into a mold shaped to conform to the exterior shape of the blade 1, the mold containing a first insert corresponding to the shape of the parts 10 and 11. This injection thus results in the formation of a blank matching the part 9. The mold is then opened and the first insert is replaced by a second smaller insert matching the part 11 of the solid body 8, leaving the previously obtained blank in the mold. The degradable composition is then injected into the remaining volume of the mold, which corresponds to the part 10. Following this, the second insert is removed from the mold, and a further injection of the ceramic based composition is effected so as to form the part 11 of the solid body 8. The parts 11 and 9 become fused together locally at their adjoining surfaces represented in FIG. 3 by reference 12.

There then remains only to cure the ceramic composition and to remove the degradable composition by heating the body 8 in a suitable atmosphere to obtain the core 5 shown in FIG. 2.

In the embodiment described above, the solid body 8 is obtained by three successive injections. It is obvious that the number of injections is dependent upon the complexity of the core 5 which is to be obtained. Similarly, the sequence of the injection operations producing the parts 9, 10 and 11 may be reversed.

As will be appreciated, the part 10 is connected to the part 9 when the part 10 is formed by the injection of the degradable composition. It suffers no degradation during the removal of the second insert from the mold, nor any deformation in the course of the second injection of the ceramic based composition. Its volume and thickness are dependent upon the sizes of the various inserts.

We claim:

1. A method of making a complex ceramic core for use in a metal casting process, the core having at least one recess which extends into the interior of said core and the core being intended for use in the manufacture of a hollow component having internal cavities and partitions, such as a blade for a turboshaft engine, by the known casting process termed the lost wax process, said method comprising the steps of successively injecting at least two compounds, one of which compounds is degradable without harming the other of said compounds, in a superimposed manner in at least one suitable mold to make a solid body wherein said other of said at least two compounds forms said core and said degradable one of said compounds fills said at least one recess of said core, the first of said injection steps creating a blank formed of one of said at least two compounds, and each successive injection step forming a layer of the injected compound covering, at least partly, the outer surface of the blank obtained in the preceding injection step, and treating said solid body to remove said degradable compound therefrom and thereby obtain said complex core, wherein a single mold is used for said successive injection steps, and wherein in each of said injection steps, except the last, a suitable insert is introduced into said mold to obtain the desired molding cavity.

* * * * *